US006641280B2

(12) United States Patent
Hanson et al.

(10) Patent No.: US 6,641,280 B2
(45) Date of Patent: Nov. 4, 2003

(54) HAND-HOLDABLE TOY LIGHT TUBE

(75) Inventors: Gary B. Hanson, Hudson, WI (US); Michael F. Weber, Shoreview, MN (US); Andrew J. Ouderkirk, Woodbury, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 127 days.

(21) Appl. No.: 09/963,304

(22) Filed: Sep. 26, 2001

(65) Prior Publication Data

US 2002/0008970 A1 Jan. 24, 2002

Related U.S. Application Data

(63) Continuation of application No. 09/408,473, filed on Sep. 28, 1999, now abandoned, which is a continuation of application No. 09/006,088, filed on Jan. 13, 1998, now Pat. No. 6,082,876.

(51) Int. Cl.[7] ..... F21L 7/00; F21V 9/12

(52) U.S. Cl. ..... 362/186; 362/101; 362/202; 362/318

(58) Field of Search ..... 362/101, 102, 362/109, 186, 202, 318, 811

(56) References Cited

U.S. PATENT DOCUMENTS

| | | | | |
|---|---|---|---|---|
| 3,037,320 | A | 6/1962 | Powell | |
| 3,124,639 | A | 3/1964 | Kahn | 88/65 |
| 3,383,675 | A | 5/1968 | Allardice et al. | |
| 3,565,985 | A | 2/1971 | Schrenk et al. | 264/171 |
| 3,610,729 | A | 10/1971 | Rogers | 350/157 |

(List continued on next page.)

FOREIGN PATENT DOCUMENTS

| | | | |
|---|---|---|---|
| FR | 2182796 | 12/1973 | |
| GB | 2199256 | 7/1988 | |
| WO | WO 95/27919 | 4/1995 | G02B/27/28 |
| WO | WO 95/17303 | 6/1995 | B23B/7/02 |
| WO | WO 95/17691 | 6/1995 | G02B/5/30 |
| WO | WO 95/17692 | 6/1995 | G02B/5/30 |
| WO | WO 95/17699 | 6/1995 | G02F/1/1335 |
| WO | WO 96/19347 | 6/1996 | B32B/7/02 |
| WO | WO 97/01440 | 1/1997 | B32B/27/36 |
| WO | WO 97/01774 | 1/1997 | G02B/1/10 |
| WO | WO 97/32226 | 9/1997 | G02B/5/30 |

OTHER PUBLICATIONS

Weber et al., U.S. patent application Ser. No. 09/006,591, filed Jan. 13, 1998.

Whitney et al., U.S. patent application Ser. No. 09/582,932, filed Jul. 5, 2000.

Neavin et al., U.S. patent application Ser. No. 09/811,200, filed Mar. 16, 2001.

Coleman, Coleman for Kids Rugged Outdoor Gear, Illumisticks product packaging, UPC 76501 91467, date unknown, at least 1997, the Coleman Company, Inc.

Engehard, Letter from Engehard Corporation, dated Apr. 11, 1997.

(List continued on next page.)

*Primary Examiner*—Sandra O'Shea
*Assistant Examiner*—Peggy A Neils
(74) *Attorney, Agent, or Firm*—Stephen C. Jensen

(57) ABSTRACT

Hand-holdable toy light tube comprising a handle, a light source and a tube of color shifting film. The light source is preferably disposed within an end of the handle. The tube of color shifting film extends from the end of the handle. During use, light from the light source interacts with the tube of color shifting film, producing a brilliant colored effect. Movement of the handle and thus of the tube of color shifting film produces multiple colors.

25 Claims, 5 Drawing Sheets

U.S. PATENT DOCUMENTS 3,711,176 A 1/1973 Alfrey, Jr. et al. ..... 350/1
3,801,429 A 4/1974 Schrenk et al. ..... 161/181
3,860,036 A 1/1975 Newman, Jr. ..... 138/45
3,964,194 A 6/1976 Gugeler ..... 40/106.21
4,208,701 A 6/1980 Schock
4,313,843 A 2/1982 Bollyky et al. ..... 252/188.3
4,446,305 A 5/1984 Rogers et al. ..... 528/348
4,520,189 A 5/1985 Rogers et al. ..... 528/331
4,521,588 A 6/1985 Rogers et al. ..... 528/363
4,525,413 A 6/1985 Rogers et al. ..... 428/212
4,600,974 A 7/1986 Lew et al. ..... 362/102
4,678,608 A 7/1987 Dugliss ..... 252/700
4,717,511 A 1/1988 Koroscil ..... 252/700
4,720,426 A 1/1988 Englert et al. ..... 428/344
4,797,308 A 1/1989 Mattin ..... 428/15
4,858,083 A 8/1989 Wakimoto ..... 362/101
4,886,687 A 12/1989 Malott ..... 428/4
5,037,346 A 8/1991 Cimock ..... 446/419
5,043,851 A 8/1991 Kaplan ..... 362/34
5,094,788 A 3/1992 Schrenk et al. ..... 264/171
5,094,793 A 3/1992 Schrenk et al. ..... 264/171
5,122,306 A 6/1992 Van Moer et al. ..... 252/700
5,165,781 A 11/1992 Orak ..... 362/186
D331,889 S 12/1992 Kaplan
5,188,760 A 2/1993 Hikmet et al. ..... 252/299.01
5,211,878 A 5/1993 Reiffenrath et al. .... 252/299.63
5,232,635 A 8/1993 Van Moer et al. ..... 252/700
5,235,443 A 8/1993 Barnik et al. ..... 359/37
5,269,995 A 12/1993 Ramanathan et al. ..... 264/171
5,279,513 A 1/1994 Connelly ..... 446/219
5,289,355 A 2/1994 Cimock
5,294,657 A 3/1994 Melendy et al. ..... 524/270
5,316,703 A 5/1994 Schrenk ..... 264/1.3
5,319,478 A 6/1994 Fijnfschilling et al. ..... 359/53
5,389,324 A 2/1995 Lewis et al. ..... 264/171
5,448,404 A 9/1995 Schrenk et al. ..... 359/584
5,451,449 A 9/1995 Shetty et al. ..... 428/195
5,486,935 A 1/1996 Kalmanash ..... 359/37
5,486,949 A 1/1996 Schrenk et al. ..... 359/498
5,519,593 A 5/1996 Hasness ..... 362/186
5,576,089 A 11/1996 Weder ..... 428/142
5,612,820 A 3/1997 Schrenk et al. ..... 359/498
5,622,423 A 4/1997 Lee ..... 362/186
5,629,055 A 5/1997 Revol et al. ..... 428/1
5,642,931 A 7/1997 Gappelberg ..... 362/186
5,683,174 A 11/1997 Lena, Jr. ..... 362/318
5,685,097 A 11/1997 Marinov ..... 40/431
5,686,979 A 11/1997 Weber et al. ..... 349/96
5,699,188 A 12/1997 Gilbert et al. ..... 359/584
5,701,720 A 12/1997 Weder ..... 53/397
5,707,915 A 1/1998 Taoda ..... 502/159
5,721,603 A 2/1998 De Vaan et al. ..... 349/194
5,744,534 A 4/1998 Ishiharada et al. ..... 524/442
5,751,388 A 5/1998 Larson ..... 349/96
5,767,935 A 6/1998 Ueda et al. ..... 349/112
5,770,306 A 6/1998 Suzuki et al. ..... 428/328
5,783,120 A 7/1998 Ouderkirk et al. ..... 264/134
5,793,456 A 8/1998 Broer et al. ..... 349/98
5,808,794 A 9/1998 Weber et al. ..... 359/487
5,825,542 A 10/1998 Cobb, Jr. et al. ..... 359/487
5,825,543 A 10/1998 Ouderkirk et al. ..... 359/494
5,882,774 A 3/1999 Jonza et al. ..... 428/212
6,080,467 A 6/2000 Weber et al.
6,082,876 A 7/2000 Hanson et al. ..... 362/293
6,207,260 B1 3/2001 Wheatley et al.

OTHER PUBLICATIONS

Flex Products, ChromaFlair® Light Interference Pigments Product Brochure Packet (consisting of a folder with an 8–page insert, and a 6–page document titled "Commonly Asked Questions" (Apr. 1997) and a seventh page titled "ChromaFlair® Preliminary Technical Data Sheet" (Apr. 1997), at least 1997.

Flex Products, Inc., ChromaFlair® Light Interference Pigments, Product Brochure, Flex Products, Inc., at least 1997.

Hasbro, Product Brochure page with Star Wars™ Products, "Luke Skywalker™ Lightsaber™" product, front and back cover, Hasbro, Inc., copyright 1996.

Mearl Corporation, "Mearl Iridescent Films, General Information", Sheet No. TIB–C, 6 pages, at least Apr. 11, 1997.

Mearl Corporation, "Mearl Standard Iridescent Films, Product Comparison Charts, Applications, and Properties", 4 pages, Oct. 1992.

Omniglow Corp., Snaplight® Lite–Up Lightstick product wrapper, Green color, Omniglow Corp., Portmouth, NH, UPC 41696 90756, date unknown, purchased in 1997.

Schrenk et al., Nanolayer polymeric optical films, Tappi Journal, pp. 169–174, Jun., 1992.

HAND-HOLDABLE TOY LIGHT TUBE

FIELD OF THE INVENTION

This application is a continuation of pending prior U.S. application Ser. No. 09/408,473, filed Sep. 28, 1999, now abandoned which is a continuation of U.S. application Ser. No. 09/006,088, filed Jan. 13, 1998, now U.S. Pat. No. 6,082,876. The present invention relates to hand-holdable toy light tubes. More particularly, it relates to a hand-holdable toy incorporating a light source and color shifting film.

BACKGROUND OF THE INVENTION

Children have long been fascinated by the appearance of illuminated or brightly-colored objects. Toy manufacturers have recognized this affinity, and currently provide a variety of different toys or novelty articles that are illuminated or brightly-colored.

Another enticing element common to many toys is a hand-holdable configuration. In other words, many children are highly attracted to and enjoy using a hand-holdable toy or novelty article which can be held and carried by the user. In this regard, several toys have been designed, for example, to include an elongated tube or stick, so as to resemble a magic wand or toy sword.

Some toys include a combination of illuminated or brightly-colored objects with a handle. For example, perhaps influenced by the movie "Star Wars"®, hand-holdable toys, some of which are sold under the trade designation "LIGHT SABER", are available. Generally, such toys include a colored, semi-transparent tube attached to a handle. The handle may further include a switch for activating an interior light source to illuminate the tube.

Other hand-holdable, illuminated novelty articles have also been devised, including fluorescent-colored cylinders (see, e.g., U.S. Pat. No. 4,678,608 (Dugliss); U.S. Pat. No. 4,717,511 (Koroscil); U.S. Pat. No. 5,043,851 (Kaplan); U.S. Pat. No. 5,122,306 (Van Moer et al.); and U.S. Pat. No. 5,232,635 (Van Moer et al.) and U.S. Design Pat. No. 331,889 (Kaplan)). Such cylinders are commonly comprised of a flexible plastic outer tube and a brittle inner tube. A first liquid is maintained within the inner tube and a second liquid maintained between the outer tube and the inner tube. When the cylinder is bent, the inner tube breaks, allowing the two liquids to mix. The resulting mixture produces a "glowing" effect. Such novelty articles are available, for example, from The Coleman Company, Inc. of Kansas under the trade designation "ILLUMISTICKS", and from Omniglow Corp. of Portsmouth, N.H. under the trade designation "SNAP-LIGHT".

While illuminated tubes and fluorescent-colored cylinders do present articles appealing to children, some inherent limitations may exist. For example, illuminated tubes and fluorescent-colored cylinders are generally unable to produce multiple colors. While it may be possible, for example, to have different colored layers of plastic as part of the illuminated tube, these colors normally will not change during use. It is believed that a multi-colored object is highly attractive. Thus, an important attribute appealing to children is unfulfilled by existing illuminated tube and fluorescent-colored cylinder toys.

Toy and other novelty article manufacturers are continually attempting to produce hand-holdable entertainment devices or toys which function in the dark. Further, many children and adults alike desire to purchase and use such products. Although there are several products available which combine an illuminated object with a handle, a need exists for a hand-holdable toy capable of producing a multi-colored, illuminated effect.

SUMMARY OF THE INVENTION

The present invention provides a hand-holdable toy light tube comprising a handle (including a first end), and a tube (including a cylinder or cone) of color shifting film extending from the first end, and a light source (i.e., the article includes a source that generates light as opposed to one that merely reflects ambient light) connected to (including within) the handle, wherein the light source is configured to be activated by a power source. Preferably, the light source is disposed at the first end of the handle. In another aspect, the light source is preferably a point light source (e.g., a flashlight). When energized or activated, the light source interacts with at least a portion of the tube of color shifting film, producing an optical effect (typically a brilliant, multi-colored effect) visible to the user and/or observer(s). Optionally, the toy light tube includes a power source electrically coupled to the light source in conjunction with a switch to control activation of the light source.

The color shifting film utilized in the present invention comprises alternating layers of at least a first and second polymeric material, wherein at least one of the first and second polymeric materials is birefringent, wherein the difference in indices of refraction of the first and second polymeric materials for visible light polarized along first and second axes in the plane of the layers is at least about 0.05, and wherein the difference in indices of refraction of the first and second polymeric materials for visible light polarized along a third axis mutually orthogonal to the first and second axes is less than about 0.05. Preferably, the color shifting film has at least one transmission band in the visible region of the spectrum and at least one reflection band (preferably having a peak reflectivity of at least about 70%, more preferably, at least 85%, even more preferably, at least 95%) in the visible region of the spectrum.

In another aspect, preferably at least one of the first or second polymeric materials of the color shifting film is positively or negatively birefringent. In another aspect, preferably the difference in indices of refraction of the first and second polymeric materials for visible light polarized along first and second axes in the plane of the layers is $\Delta x$ and $\Delta y$, respectively, wherein the difference in indices of refraction of the first and second polymeric materials for visible light polarized along a third axis mutually orthogonal to the first and second axes is $\Delta z$, and wherein the absolute value of $\Delta z$ is less than about one half (in some embodiments one quarter, or even one tenth) the larger of the absolute value of $\Delta x$ and the absolute value of $\Delta y$.

Further with regard to the color shifting film, at least one of the first and second materials can be a strain hardening polyester (e.g., a naphthalene dicarboxylic acid polyester or a methacrylic acid polyester). In other aspect, the first polymeric material can be polyethylene naphthalate and the second polymeric material polymethylmethacrylate.

In one preferred embodiment of the present invention, the tube of color shifting film is configured to resemble an elongated cone. In another preferred embodiment, the tube of color shifting film is configured to telescopically extend and retract relative to the handle. During use of the latter, the tube of color shifting film can be rapidly displaced via movement of the handle, enhancing the visual effect.

Certain preferred color shifting films used in the present invention are advantageous over prior art color films in many respects. For example, while color shifting films based on isotropic materials are known, these preferred films exhibit decreased reflectivities at non-normal angles of incidence, which diminishes the intensity of the reflected wavelengths at non-normal angles of incidence. Hence, such films appear lighter and have less saturated colors at oblique angles. Other color shifting films change their spectral profile as a function of angle, resulting in diminished color purity and/or less dramatic color shifts with angle.

BRIEF DESCRIPTION OF THE DRAWING

The accompanying drawing is included to provide a further understanding of the present invention and is incorporated in and constitutes a part of the specification. The drawing illustrates exemplary embodiments of the present invention and together with the description serves to further explain the principles of the invention. Other aspects of the present invention and many of the attendant advantages of the present invention will be readily appreciated as the same becomes better understood by reference to the following Detailed Description when considered in conjunction with the accompanying drawing, and wherein.

DETAILED DESCRIPTION

Figure 1:
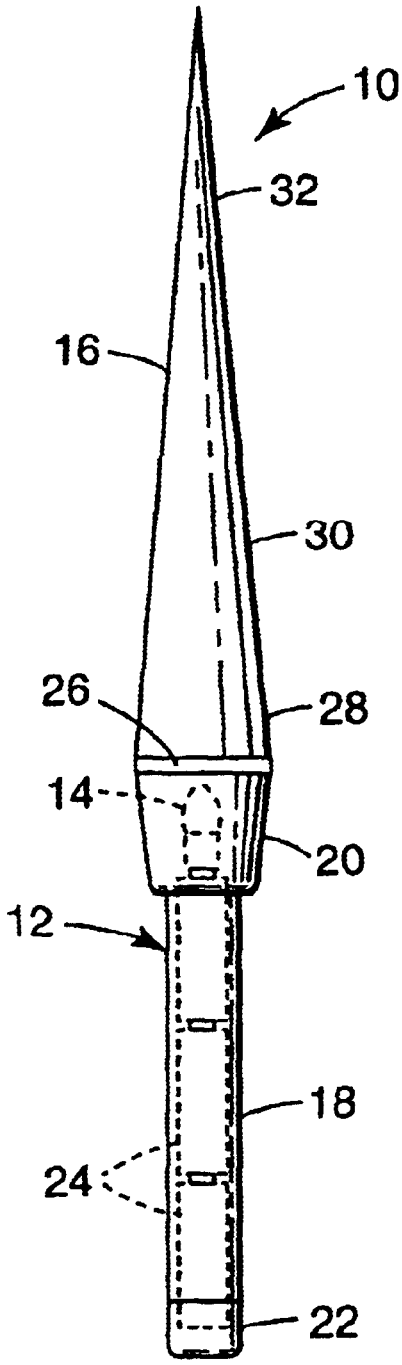
FIG. 1 is a side view of a hand-holdable toy light tube according to the present invention.

Referring to FIG. 1, exemplary hand-holdable toy light tube according to the present invention 10 includes handle 12, light source 14, and tube of color shifting film 16. Handle 12 has body 18 and ends 20, 22. Light source 14 is connected to the handle and is configured to be powered by power source 24 (e.g., batteries shown in dashed lines), and is disposed at end 20 of handle 12. Tube of color shifting film 16 extends from end 20 of handle 12.

Tube of color shifting film 16 can be disposed in a number of different manners. Activation of light source 14 directs light within at least a portion of tube of color shifting film 16. Tube of color shifting film 16, which is partially translucent (or transmissive) (and is typically partially reflective), transmits, or transmits and reflects, light from light source 14, producing a visual (e.g., brightly colored) effect.

In one preferred embodiment, hand-holdable toy light tube 10 resembles an elongated cone or sword, although the tube can also be, for example, cylindrical or a conic section. Body 18 is preferably hollow to contain power source 24 (e.g., a battery) for powering light source 14. End 22 is preferably threadably secured to body 18, and end 20 is preferably rotatably secured to body 18.

End 20 is preferably configured to receive and maintain light source 14. Further, end 20 optionally includes translucent or filtered leading edge 26 (e.g., a clear lens) through which light from light source 14 can pass. In this regard, end 20 is configured to direct light from light source 14 to leading edge 26.

In one preferred embodiment, handle 12 is, or is similar to, a flashlight wherein, for example, body 18 and ends 20, 22 can be manufactured separately, but are configured for integral attachment. In this regard, end 22 can be threadably secured to body 18 to maintain power source 24 within body 18. End 20 is preferably rotatably secured to body 18 and acts as a switch operably connected between power source 24 and light source 14. That is, rotation of end 20 relative to body 18 moves light source 14 into and out of electrical contact with power source 24. Alternatively, for example, end 20 can be permanently secured to body 18 and finger-operated switch can be disposed, for example, along an outer circumference of body 18 for activating light source 14.

Components of hand-holdable toy light tubes according to the present invention can be made of any suitable material, including those disclosed herein, although some materials may be more suitable than others depending, for example, upon the particular toy use. For example, suitable materials for the handle may include rigid material (e.g., hard plastic, aluminum, stainless steel or wood) or more flexible materials such as rubber.

Regardless of the type of radiation, the term "illuminate" is used herein to indicate that the color shifting film is exposed to the radiation emitted from the light source. The light source can be, for example, electrical and/or chemical (e.g., chemiluminescent (see, e.g., U.S. Pat. No. 4,717,511 (Koroscil), U.S. Pat. No. 5,043,851 (Kaplan), and U.S. Pat. No. 5,232,635 (Van Moer et al.)), the disclosures of which are incorporated herein by reference. Preferably, the light source emits visible (i.e., electromagnetic radiation having one or more wavelengths in the range from about $4\times10^{-7}$ m to $7\times10^{-7}$ m) and/or UV radiation (i.e., electromagnetic radiation having one or more wavelengths in the range from about $6\times10^{-8}$ m to $4\times10^{-7}$ m), although for some uses (e.g., photographic or electronic recording) other wavelengths of radiation compatible with the recording media or recording sensor may also be useful. Further, it is understood that one skilled in the art would select a light source(s) for emitting the wavelength(s) of light and a color shifting film(s) which provide a desired visible effect.

The light source is preferably an incandescent light bulb, although other light sources such as a black light lamp, a halogen lamp, or a light emitting diode can also be used. The light source may include a plurality of lamps. Even further, for example, the light source can be configured to have a spikey spectral distribution. Preferably, the light source emits radiation toward the tube of color shifting film. Preferred light sources which also have handles include flashlights (including those marketed by MAG Instrument of Ontario, Calif. under the trade designation "MAGLITE").

The color shifting films used in the present invention are those described in U.S. Ser. No. 09/006,591, filed Jan. 13, 1998, the disclosure of which is incorporated herein by reference. These color shifting films are multilayer birefringent polymeric films having particular relationships between the refractive indices of successive layers for light polarized along mutually orthogonal in-plane axes (the x-axis and the y-axis) and along an axis perpendicular to the in-plane axes (the z-axis). In particular, the differences in refractive indices along the x-, y-, and z-axes ($\Delta x$, $\Delta y$, and $\Delta z$, respectively)

are such that the absolute value of $\Delta z$ is less than about one half (in some embodiments one quarter, or even one tenth) the larger of the absolute value of $\Delta x$ and the absolute value of $\Delta y$ (e.g., ($|\Delta z|<0.5$ k (in some embodiments 0.25 k, or even 0.1 k), $k=\max\{|\Delta x|, |\Delta y|\}$). Films having this property can be made to exhibit transmission spectra in which the widths and intensities of the transmission or reflection peaks (when plotted as a function of frequency, or $1/\lambda$) for p-polarized light remain essentially constant over a wide range of viewing angles, but shift in wavelength as a function of angle. Also for p-polarized light, the spectral features shift toward the blue region of the spectrum at a higher rate with angle change than the spectral features of isotropic thin film stacks. In some embodiments, these color shifting films have at least one optical stack in which the optical thicknesses of the individual layers change monotonically in one direction (e.g., increasing or decreasing) over a first portion of the stack, and then change monotonically in a different direction or remain constant over at least a second portion of the stack. Color shifting films having stack designs of this type exhibit a sharp band edge at one or both sides of the reflection band(s), causing the film to exhibit sharp, eye-catching color changes as a function of viewing angle.

Preferably, the color shifting film reflects and transmits light typically over a wide bandwidth such that when lit, the tube of color shifting film appears brightly colored. Further, in a preferred construction, the tube of color shifting film typically exhibits a variety of bright or brilliant colors.

Further, color shifting films can be regarded as special cases of mirror and polarizing (optical) films. Various process considerations are important in making high quality optical films and other optical devices in accordance with the present invention. Such optical films include, but are not limited to polarizers, mirrors, colored films, and combinations thereof, which are optically effective over diverse portions of the ultraviolet, visible, and infrared spectra. The process conditions used to make each film will depend in part on the particular resin system used and the desired optical properties of the final film. The following description is intended as an overview of those process considerations common to many resin systems used in making the coextruded optical films useful for the present invention.

Material Selection

Regarding the materials from which the films are to be made, there are several conditions which must be met that are common to certain preferred multilayer optical films for use in the present invention. First, these films comprise at least two distinguishable polymers. The number is not limited, and three or more polymers may be advantageously used in particular films. Second, one of the two required polymers, referred to as the "first polymer", must have a stress optical coefficient having a large absolute value. In other words, it must be capable of developing a large birefringence when stretched. Depending on the application, this birefringence may be developed between two orthogonal directions in the plane of the film, between one or more in-plane directions and the direction perpendicular to the film plane, or a combination of these. Third, the first polymer must be capable of maintaining this birefringence after stretching, so that the desired optical properties are imparted to the finished film. Fourth, the other required polymer, referred to as the "second polymer", must be chosen so that in the finished film, its refractive index, in at least one direction, differs significantly from the index of refraction of the first polymer in the same direction. Because polymeric materials are dispersive, that is, the refractive indices vary with wavelength, these conditions must be considered in terms of a spectral bandwidth of interest.

Other aspects of polymer selection depend on specific applications. For polarizing films, it is advantageous for the difference in the index of refraction of the first and second polymers in one film-plane direction to differ significantly in the finished film, while the difference in the orthogonal film-plane index is minimized. If the first polymer has a large refractive index when isotropic, and is positively birefringent (that is, its refractive index increases in the direction of stretching), the second polymer will be chosen to have a matching refractive index, after processing, in the planar direction orthogonal to the stretching direction, and a refractive index in the direction of stretching which is as low as possible. Conversely, if the first polymer has a small refractive index when isotropic, and is negatively birefringent, the second polymer will be chosen to have a matching refractive index, after processing, in the planar direction orthogonal to the stretching direction, and a refractive index in the direction of stretching which is as high as possible.

Alternatively, it is possible to select a first polymer which is positively birefringent and has an intermediate or low refractive index when isotropic, or one which is negatively birefringent and has an intermediate or high refractive index when isotropic. In these cases, the second polymer may be chosen so that, after processing, its refractive index will match that of the first polymer in either the stretching direction or the planar direction orthogonal to stretching. Further, the second polymer will be chosen such that the difference in index of refraction in the remaining planar direction is maximized, regardless of whether this is best accomplished by a very low or very high index of refraction in that direction.

One means of achieving this combination of planar index matching in one direction and mis-matching in the orthogonal direction is to select a first polymer which develops significant birefringence when stretched, and a second polymer which develops little or no birefringence when stretched, and to stretch the resulting film in only one planar direction. Alternatively, the second polymer may be selected from among those which develop birefringence in the sense opposite to that of the first polymer (negative-positive or positive-negative). Another alternative method is to select both first and second polymers which are capable of developing birefringence when stretched, but to stretch in two orthogonal planar directions, selecting process conditions, such as temperatures, stretch rates, post-stretch relaxation, and the like, which result in development of unequal levels of orientation in the two stretching directions for the first polymer, and levels of orientation for the second polymer such that one in-plane index is approximately matched to that of the first polymer, and the orthogonal in-plane index is significantly mismatched to that of the first polymer. For example, conditions may be chosen such that the first polymer has a biaxially oriented character in the finished film, while the second polymer has a predominantly uniaxially oriented character in the finished film.

The foregoing is meant to be exemplary, and it will be understood that combinations of these and other techniques may be employed to achieve the polarizing film goal of index mismatch in one in-plane direction and relative index matching in the orthogonal planar direction.

Different considerations apply to a reflective, or mirror, film. Provided that the film is not meant to have some polarizing properties as well, refractive index criteria apply equally to any direction in the film plane, so it is typical for the indices for any given layer in orthogonal in-plane directions to be equal or nearly so. It is advantageous, however, for the film-plane indices of the first polymer to differ as greatly as possible from the film-plane indices of the second polymer. For this reason, if the first polymer has a high index of refraction when isotropic, it is advantageous that it also be positively birefringent. Likewise, if the first polymer has a low index of refraction when isotropic, it is advantageous that it also be negatively birefringent. The second polymer advantageously develops little or no birefringence when stretched, or develops birefringence of the opposite sense (positive-negative or negative-positive), such that its film-plane refractive indices differ as much as possible from those of the first polymer in the finished film. These criteria may be combined appropriately with those listed above for polarizing films if a mirror film is meant to have some degree of polarizing properties as well.

As mentioned above, color shifting films can be regarded as special cases of mirror and polarizing films. Thus, the same criteria outlined above apply. The perceived color is a result of reflection or polarization over one or more specific bandwidths of the spectrum. The bandwidths over which a multilayer film of the current invention is effective will be determined primarily by the distribution of layer thicknesses employed in the optical stack(s), but consideration must also be given to the wavelength dependence, or dispersion, of the refractive indices of the first and second polymers. It will be understood that the same rules apply to the infrared and ultraviolet wavelengths as to the visible colors.

Absorbance is another consideration. For most applications, it is advantageous for neither the first polymer nor the second polymer to have any absorbance bands within the bandwidth of interest for the film in question. Thus, all incident light within the bandwidth is either reflected or transmitted. However, for some applications, it may be useful for one or both of the first and second polymer to absorb specific wavelengths, either totally or in part.

Polyethylene 2,6-naphthalate (PEN) is frequently chosen as a first polymer for films of the present invention. It has a large positive stress optical coefficient, retains birefringence effectively after stretching, and has little or no absorbance within the visible range. It also has a large index of refraction in the isotropic state. Its refractive index for polarized incident light of 550 nm wavelength increases when the plane of polarization is parallel to the stretch direction from about 1.64 to as high as about 1.9. Its birefringence can be increased by increasing its molecular orientation which, in turn, may be increased by stretching to greater stretch ratios with other stretching conditions held fixed.

Other semicrystalline naphthalene dicarboxylic polyesters are also suitable as first polymers. Polybutylene 2,6-Naphthalate (PBN) is an example. These polymers may be homopolymers or copolymers, provided that the use of comonomers does not substantially impair the stress optical coefficient or retention of birefringence after stretching. The term "PEN" herein will be understood to include copolymers of PEN meeting these restrictions. In practice, these restrictions imposes an upper limit on the comonomer content, the exact value of which will vary with the choice of comonomer(s) employed. Some compromise in these properties may be accepted, however, if comonomer incorporation results in improvement of other properties. Such properties include but are not limited to improved interlayer adhesion, lower melting point (resulting in lower extrusion temperature), better rheological matching to other polymers in the film, and advantageous shifts in the process window for stretching due to change in the glass transition temperature.

Suitable comonomers for use in PEN, PBN or the like may be of the diol or dicarboxylic acid or ester type. Dicarboxylic acid comonomers include but are not limited to terephthalic acid, isophthalic acid, phthalic acid, all isomeric naphthalenedicarboxylic acids (2,6-, 1,2-, 1,3-, 1,4-, 1,5-, 1,6-, 1,7-, 1,8-, 2,3-, 2,4-, 2,5-, 2,7-, and 2,8-), bibenzoic acids such as 4,4'-biphenyl dicarboxylic acid and its isomers, trans-4,4'-stilbene dicarboxylic acid and its isomers, 4,4'-diphenyl ether dicarboxylic acid and its isomers, 4,4'-diphenylsulfone dicarboxylic acid and its isomers, 4,4'-benzophenone dicarboxylic acid and its isomers, halogenated aromatic dicarboxylic acids such as 2-chloroterephthalic acid and 2,5-dichloroterephthalic acid, other substituted aromatic dicarboxylic acids such as tertiary butyl isophthalic acid and sodium sulfonated isophthalic acid, cycloalkane dicarboxylic acids such as 1,4-cyclohexanedicarboxylic acid and its isomers and 2,6-decahydronaphthalene dicarboxylic acid and its isomers, bi- or multi-cyclic dicarboxylic acids (such as the various isomeric norbornane and norbornene dicarboxylic acids, adamantane dicarboxylic acids, and bicyclo-octane dicarboxylic acids), alkane dicarboxylic acids (such as sebacic acid, adipic acid, oxalic acid, malonic acid, succinic acid, glutaric acid, azelaic acid, and dodecane dicarboxylic acid.), and any of the isomeric dicarboxylic acids of the fused-ring aromatic hydrocarbons (such as indene, anthracene, pheneanthrene, benzonaphthene, fluorene and the like). Alternatively, alkyl esters of these monomers, such as dimethyl terephthalate, may be used.

Suitable diol comonomers include but are not limited to linear or branched alkane diols or glycols (such as ethylene glycol, propanediols such as trimethylene glycol, butanediols such as tetramethylene glycol, pentanediols such as neopentyl glycol, hexanediols, 2,2,4-trimethyl-1,3-pentanediol and higher diols), ether glycols (such as diethylene glycol, triethylene glycol, and polyethylene glycol), chain-ester diols such as 3-hydroxy-2,2-dimethylpropyl-3-hydroxy-2,2-dimethyl propanoate, cycloalkane glycols such as 1,4-cyclohexanedimethanol and its isomers and 1,4-cyclohexanediol and its isomers, bi- or multicyclic diols (such as the various isomeric tricyclodecane dimethanols, norbornane dimethanols, norbornene dimethanols, and bicyclo-octane dimethanols), aromatic glycols (such as 1,4-benzenedimethanol and its isomers, 1,4-benzenediol and its isomers, bisphenols such as bisphenol A, 2,2'-dihydroxy biphenyl and its isomers, 4,4'-dihydroxymethyl biphenyl and its isomers, and 1,3-bis(2-hydroxyethoxy)benzene and its isomers), and lower alkyl ethers or diethers of these diols, such as dimethyl or diethyl diols.

Tri- or polyfunctional comonomers, which can serve to impart a branched structure to the polyester molecules, can also be used. They may be of either the carboxylic acid, ester, hydroxy or ether types. Examples include, but are not limited to, trimellitic acid and its esters, trimethylol propane, and pentaerythritol.

Also suitable as comonomers are monomers of mixed functionality, including hydroxycarboxylic acids such as parahydroxybenzoic acid and 6-hydroxy-2-naphthalenecarboxylic acid, and their isomers, and tri- or polyfunctional comonomers of mixed functionality such as 5-hydroxyisophthalic acid and the like.

Polyethylene terephthalate (PET) is another material that exhibits a significant positive stress optical coefficient, retains birefringence effectively after stretching, and has little or no absorbance within the visible range. Thus, it and its high PET-content copolymers employing comonomers listed above may also be used as first polymers in some applications of the current invention.

When a naphthalene dicarboxylic polyester such as PEN or PBN is chosen as first polymer, there are several approaches which may be taken to the selection of a second polymer. One preferred approach for some applications is to select a naphthalene dicarboxylic copolyester (coPEN) formulated so as to develop significantly less or no birefringence when stretched. This can be accomplished by choosing comonomers and their concentrations in the copolymer such that crystallizability of the coPEN is eliminated or greatly reduced. One typical formulation employs as the dicarboxylic acid or ester components dimethyl naphthalate at from about 20 mole percent to about 80 mole percent and dimethyl terephthalate or dimethyl isophthalate at from about 20 mole percent to about 80 mole percent, and employs ethylene glycol as diol component. Of course, the corresponding dicarboxylic acids may be used instead of the esters. The number of comonomers which can be employed in the formulation of a coPEN second polymer is not limited. Suitable comonomers for a coPEN second polymer include but are not limited to all of the comonomers listed above as suitable PEN comonomers, including the acid, ester, hydroxy, ether, tri- or polyfunctional, and mixed functionality types.

Often it is useful to predict the isotropic refractive index of a coPEN second polymer. A volume average of the refractive indices of the monomers to be employed has been found to be a suitable guide. Similar techniques well-known in the art can be used to estimate glass transition temperatures for coPEN second polymers from the glass transitions of the homopolymers of the monomers to be employed.

In addition, polycarbonates having a glass transition temperature compatible with that of PEN and having a refractive index similar to the isotropic refractive index of PEN are also useful as second polymers. Polyesters, copolyesters, polycarbonates, and copolycarbonates may also be fed together to an extruder and transesterified into new suitable copolymeric second polymers.

It is not required that the second polymer be a copolyester or copolycarbonate. Vinyl polymers and copolymers made from monomers such as vinyl naphthalenes, styrenes, ethylene, maleic anhydride, acrylates, acetates, and methacrylates may be employed. Condensation polymers other than polyesters and polycarbonates may also be used. Examples include: polysulfones, polyamides, polyurethanes, polyamic acids, and polyimides. Naphthalene groups and halogens such as chlorine, bromine and iodine are useful for increasing the refractive index of the second polymer to a desired level. Acrylate groups and fluorine are particularly useful in decreasing refractive index when this is desired.

It will be understood from the foregoing discussion that the choice of a second polymer is dependent not only on the intended application of the multilayer optical film in question, but also on the choice made for the first polymer, and the processing conditions employed in stretching. Suitable second polymer materials include but are not limited to polyethylene naphthalate (PEN) and isomers thereof (such as 2,6-, 1,4-, 1,5-, 2,7-, and 2,3-PEN), polyalkylene terephthalates (such as polyethylene terephthalate, polybutylene terephthalate, and poly-1,4-cyclohexanedimethylene terephthalate), other polyesters, polycarbonates, polyarylates, polyamides (such as nylon 6, nylon 11, nylon 12, nylon 4/6, nylon 6/6, nylon 6/9, nylon 6/10, nylon 6/12, and nylon 6/T), polyimides (including thermoplastic polyimides and polyacrylic imides), polyamide-imides, polyether-amides, polyetherimides, polyaryl ethers (such as polyphenylene ether and the ring-substituted polyphenylene oxides), polyarylether ketones such as polyetheretherketone ("PEEK"), aliphatic polyketones (such as copolymers and terpolymers of ethylene and/or propylene with carbon dioxide), polyphenylene sulfide, polysulfones (including polyethersulfones and polyaryl sulfones), atactic polystyrene, syndiotactic polystyrene ("sPS") and its derivatives (such as syndiotactic poly-alpha-methyl styrene and syndiotactic polydichlorostyrene), blends of any of these polystyrenes (with each other or with other polymers, such as polyphenylene oxides), copolymers of any of these polystyrenes (such as styrene-butadiene copolymers, styrene-acrylonitrile copolymers, and acrylonitrilebutadiene-styrene terpolymers), polyacrylates (such as polymethyl acrylate, polyethyl acrylate, and polybutyl acrylate), polymethacrylates (such as polymethyl methacrylate, polyethyl methacrylate, polypropyl methacrylate, and polyisobutyl methacrylate), cellulose derivatives (such as ethyl cellulose, cellulose acetate, cellulose propionate, cellulose acetate butyrate, and cellulose nitrate), polyalkylene polymers (such as polyethylene, polypropylene, polybutylene, polyisobutylene, and poly(4-methyl)pentene), fluorinated polymers and copolymers (such as polytetrafluoroethylene, polytrifluoroethylene, polyvinylidene fluoride, polyvinyl fluoride, fluorinated ethylene-propylene copolymers, perfluoroalkoxy resins, polychlorotrifluoroethylene, polyethylene-co-trifluoroethylene, polyethylene-co-chlorotrifluoroethylene), chlorinated polymers (such as polyvinylidene chloride and polyvinyl chloride), polyacrylonitrile, polyvinylacetate, polyethers (such as polyoxymethylene and polyethylene oxide), ionomeric resins, elastomers (such as polybutadiene, polyisoprene, and neoprene), silicone resins, epoxy resins, and polyurethanes.

Also suitable are copolymers, such as the copolymers of PEN discussed above as well as any other non-naphthalene group-containing copolyesters which may be formulated from the above lists of suitable polyester comonomers for PEN. In some applications, especially when PET serves as the first polymer, copolyesters based on PET and comonomers from the lists above (coPETs) are especially suitable. In addition, either first or second polymers may consist of miscible or immiscible blends of two or more of the above-described polymers or copolymers (such as blends of sPS and atactic polystyrene, or of PEN and sPS). The coPENs and coPETs described may be synthesized directly, or may be formulated as a blend of pellets where at least one component is a polymer based on naphthalene dicarboxylic acid or terephthalic acid and other components are polycarbonates or other polyesters, such as a PET, a PEN, a coPET, or a co-PEN.

Another preferred family of materials for the second polymer for some applications are the syndiotactic vinyl aromatic polymers, such as syndiotactic polystyrene. Syndiotactic vinyl aromatic polymers useful in the current invention include poly(styrene), poly(alkyl styrene)s, poly(aryl styrene)s, poly(styrene halide)s, poly(alkoxy styrene)s, poly(vinyl ester benzoate), poly(vinyl naphthalene), poly(vinylstyrene), and poly(acenaphthalene), as well as the hydrogenated polymers and mixtures or copolymers containing these structural units. Examples of poly(alkyl styrene)s include the isomers of the following: poly(methyl styrene), poly(ethyl styrene), poly(propyl styrene), and poly(butyl styrene). Examples of poly(aryl styrene)s include the isomers of poly(phenyl styrene). As for the poly(styrene halide)s, examples include the isomers of the following: poly(chlorostyrene), poly(bromostyrene), and poly(fluorostyrene). Examples of poly(alkoxy styrene)s include the isomers of the following: poly(methoxy styrene) and poly(ethoxy styrene). Among these examples, particularly preferable styrene group polymers, are: polystyrene, poly (p-methyl styrene), poly(m-methyl styrene), poly(p-tertiary butyl styrene), poly(p-chlorostyrene), poly(m-chloro styrene), poly(p-fluoro styrene), and copolymers of styrene and p-methyl styrene.

Furthermore, comonomers may be used to make syndiotactic vinyl aromatic group copolymers. In addition to the monomers for the homopolymers listed above in defining the syndiotactic vinyl aromatic polymers group, suitable comonomers include olefin monomers (such as ethylene, propylene, butenes, pentenes, hexenes, octenes or decenes), diene monomers (such as butadiene and isoprene), and polar vinyl monomers (such as cyclic diene monomers, methyl methacrylate, maleic acid anhydride, or acrylonitrile).

The syndiotactic vinyl aromatic copolymers of the present invention may be block copolymers, random copolymers, or alternating copolymers.

The syndiotactic vinyl aromatic polymers and copolymers referred to in this invention generally have syndiotacticity of higher than 75% or more, as determined by carbon-13 nuclear magnetic resonance. Preferably, the degree of syndiotacticity is higher than 85% racemic diad, or higher than 30%, or more preferably, higher than 50%, racemic pentad.

In addition, although there are no particular restrictions regarding the molecular weight of these syndiotactic vinyl aromatic polymers and copolymers, preferably, the weight average molecular weight is greater than 10,000 and less than 1,000,000, and more preferably, greater than 50,000 and less than 800,000.

The syndiotactic vinyl aromatic polymers and copolymers may also be used in the form of polymer blends with, for instance, vinyl aromatic group polymers with atactic structures, vinyl aromatic group polymers with isotactic structures, and any other polymers that are miscible with the vinyl aromatic polymers. For example, polyphenylene ethers show good miscibility with many of the previous described vinyl aromatic group polymers.

When a polarizing film is made using a process with predominantly uniaxial stretching, particularly preferred combinations of polymers for optical layers include PEN/coPEN, PET/coPET, PEN/sPS, PET/sPS, PEN/"ESTAR," and PET/"ESTAR," where "coPEN" refers to a copolymer or blend based upon naphthalene dicarboxylic acid (as described above) and "ESTAR" refers to is a polyester or copolyester (believed to comprise cyclohexanedimethylene diol units and terephthalate units) commercially available under the trade designation "ESTAR" from Eastman Chemical Co. When a polarizing film is to be made by manipulating the process conditions of a biaxial stretching process, particularly preferred combinations of polymers for optical layers include PEN/coPEN, PEN/PET, PEN/PBT, PEN/PETG and PEN/PETcoPBT, where "PBT" refers to polybutylene terephthalate, "PETG" refers to a copolymer of PET employing a second glycol (usually cyclohexanedimethanol), and "PETcoPBT" refers to a copolyester of terephthalic acid or an ester thereof with a mixture of ethylene glycol and 1,4-butanediol.

Particularly preferred combinations of polymers for optical layers in the case of mirrors or colored films include PEN/PMMA, PET/PMMA, PEN/"ECDEL," PET/"ECDEL," PEN/sPS, PET/sPS, PEN/coPET, PEN/PETG, and PEN/ "THV," where "PMMA" refers to polymethyl methacrylate, "ECDEL" refers to a thermoplastic polyester or copolyester (believed to comprise cyclohexanedicarboxylate units, polytetramethylene ether glycol units, and cyclohexanedimethanol units) commercially available under the trade designation "ECDEL" from Eastman Chemical Co., "coPET" refers to a copolymer or blend based upon terephthalic acid (as described above), "PETG" refers to a copolymer of PET employing a second glycol (usually cyclohexanedimethanol), and "THV" is a fluoropolymer commercially available under the trade designation "THV" from the 3M Company.

It is sometimes preferred for the multilayer optical films of the current invention to consist of more than two distinguishable polymers. A third or subsequent polymer might be fruitfully employed as an adhesion-promoting layer between the first polymer and the second polymer within an optical stack, as an additional component in a stack for optical purposes, as a protective boundary layer between optical stacks, as a skin layer, as a functional coating, or for any other purpose. As such, the composition of a third or subsequent polymer, if any, is not limited. Preferred multicomponent constructions are described in U.S. Pat. No. 6,207,260 (Wheatley et al.), the disclosure of which is incorporated by reference.

Detailed process considerations and additional layers are included in U.S. application Ser. No. 09/006,288, filed Jan. 13, 1998, abandoned, the disclosure of which is incorporated by reference. Further, additional details regarding optical films are described in applications having U.S. Ser. No. 08/402,041, filed Mar. 10, 1995; Ser. No. 08/494,366, filed Jun. 26, 1995; and Ser. No. 09/006,601, filed Jan. 13, 1998, the disclosures of which are incorporated herein by reference.

In one embodiment according to the present invention, the hand-holdable toy light tube includes a section of non-color shifting film (or other material, (e.g., paper)) interposed with the tube of color shifting film.

Referring again to FIG. 1, tube of color shifting film 16 is preferably formed into a cone having a first, proximal end 28, intermediate portion 30, and second, distal end 32. Proximal end 28 is configured for attachment to end 20 of handle 12. Intermediate portion 30 extends from proximal end 28 and is preferably constructed to be relatively rigid. Distal end 32 is unattached or free. Thus, tube of color shifting film 16 is configured such that movement of handle 12 imparts a similar movement onto tube of color shifting film 16. In other words, tube of color shifting film 16 will move in the same direction as handle 12.

As described in greater detail below, tube of color shifting film 16 can be formed by wrapping or curving a continuous strip of color shifting film. In one preferred embodiment, the color shifting film is configured such that when curved, intermediate portion 30 exhibits at least two different (optically discemable) colors (e.g., green in transmission at normal incidence and pink (or magenta) in transmission at oblique angles) upon movement. That is, one portion of intermediate portion 30 is one color, and another portion is a different color when viewed from the same location or position. Similarly, the color shifting film is preferably configured such that intermediate portion 30 exhibits at least two different colors (e.g., pink and green) upon movement. That is, upon movement of tube of color shifting film 16, a portion of intermediate portion 30 will exhibit different colors when viewed from the same location or position.

Tube of color shifting film 16 is preferably cut from a single sheet of color shifting film. Further, because tube of color shifting film 16 is typically relatively rigid, the extended position of tube of color shifting film 16 relative to handle 12 is generally maintained regardless of the position or movement of handle 12.

Hand-holdable toy light tube 10 of one preferred embodiment can be constructed, for example, as follows. Light source 14 (e.g., a flashlight) is disposed at or near end 20 of handle 12. Tube of color shifting film 16 is curved or wrapped relative to handle 12 such that proximal end 28 is formed about and attached to end 20 of handle 12 by an adhesive material (e.g., adhesive tape, curable liquid adhesive, or the like). The sheet of color shifting film comprising tube of color shifting film 16 may or may not be overlapped. In one preferred embodiment, tube of color shifting film 16 is curved to form a cone, such that distal end 32 forms a closed tip. Thus, an interior of tube of color shifting film 16 is typically filled with air, although other mediums permitting passage of light may also be useful. In other embodiments according to the present invention, distal end 32 need not be closed. In other words, tube of color shifting film 16 may be curved relative to handle 12 such that distal end 30 is open, so that tube of color shifting film 16 is a right cylinder. With this configuration, some light will pass outwardly from distal end 30, projecting onto a nearby wall or ceiling. It is also within the scope of the present invention to have an additional strip of color shifting film or other material placed over distal end 32 to close distal end 32. Even further, while tube of color shifting film 16 is shown as having a circular cross-section, other shapes are acceptable. For example, the tube of color shifting film may be elliptical in cross-section. Alternatively, the tube of color shifting film may have a polyhedral cross-section, such as hexagonal or octagonal.

During use, light source 14 in one preferred embodiment is activated by rotating end 20 of handle 12 relative to body 18, although other ways of activating light source 14 (e.g., a separate switch) are also useful. Once lit, light from light source 14 interacts with tube of color shifting film 16. In one preferred embodiment, light from light source 14 is directed through leading edge 26 of handle 12 into tube of color shifting film 16.

The visual appearance of the hand-holdable toy light tube according to the present invention is enhanced by the inherently curved surface of the tube of color shifting film. With this arrangement, where hand-holdable toy light tube 10 is maintained in a stationary position, and a viewer changes positions relative to hand-holdable toy light tube 10, the viewer will perceive a change in color. Thus, tube of color shifting film 16 is preferably configured such that when viewed from a first location, tube of color shifting film 16 exhibits a first optical characteristic (e.g., a first color), and when viewed from a second location, tube of color shifting film 16 exhibits a second optical characteristic (e.g., a second color) different from the first optical characteristic. Alternatively, for example, tube of color shifting film 16 itself can be moved such that a stationary viewer perceives a change in optical characteristic (e.g., color).

When viewed normally to its principle axis, hand-holdable toy light tube 10 exhibits a unique multicolored glow. In particular, tube of color shifting film 16 has a central "plasma appearing" core surrounded by a progression of increasingly narrower layers of the remaining spectral colors. As hand-holdable toy light tube 10 is tilted toward or away from a viewer, the outer layers of colors appear to collapse in on the central core of tube of color shifting film 16 until, in some instances, only a single color remains. Even further, for example, tube of color shifting film 16 can be made of non-uniformly colored film which appears from movement to shimmer when illuminated by light source 14, similar to an unstable plasma in a vacuum tube.

The visual appearance of tube of color shifting film 16 can be altered, for example, by including a translucent filter at a leading edge of the handle (e.g., leading end 26 of handle 12 in FIG. 1). The filter can alter the wavelengths of light emitted by the light source, thus varying the color(s) produced by the tube of color shifting. For example, the filter can be configured to concentrate or diffuse the light emitted by the light source. Even further, the filter could be configured to concentrate the light in some areas and diffuse the light in others. Optionally, the filter is or includes color shifting film.

Figure 2:
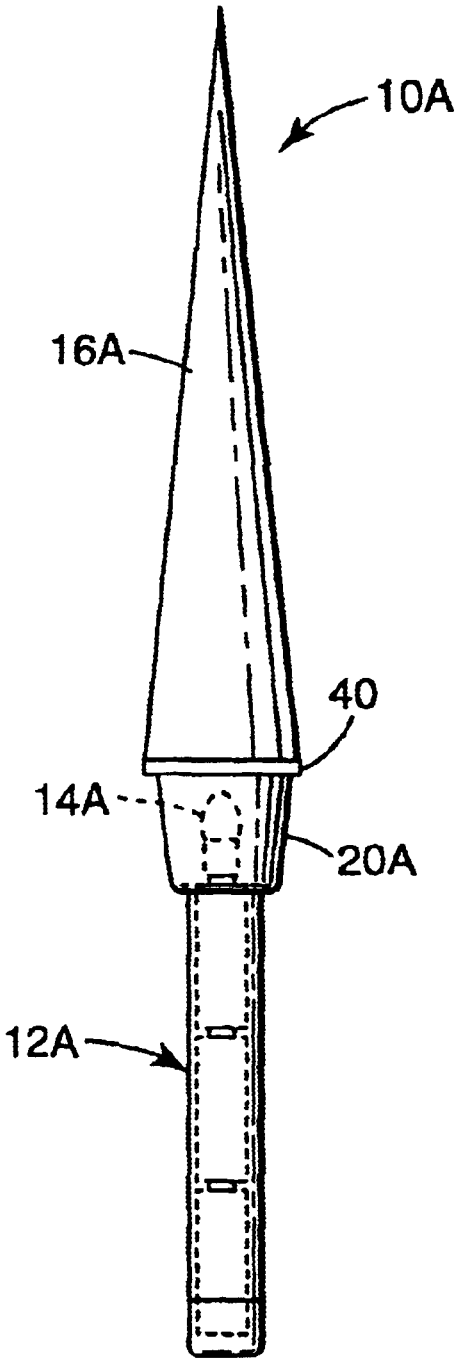
FIG. 2 is a side view of another hand-holdable toy light tube according to the present invention.

In some embodiments according to the present invention (see, e.g., FIG. 1) tube of color shifting film 16 is attached directly to an end of the handle. Other forms of attachment are also useful. For example, FIG. 2 illustrates an alternative embodiment of hand-holdable toy light tube according to the present invention 10A, which is similar to device 10 shown in FIG. 1. Toy light tube 10A includes handle 12A, light source 14A, tube of color shifting film 16A, and attachment body 40 for connecting tube of color shifting film 16A to end 20A of handle 12A. Although attachment body 40 is shown as a band of color shifting film integrally formed with tube of color shifting film 16A, it may be in other suitable forms, such as opaque or translucent plastic. With respect to the form shown, during manufacture, an appropriately sized sheet of color shifting film can be cut and curved to provide tube of color shifting film 16A. Attachment body 40 can be, for example, a disk or ring attached to end 20A of handle 12A. Tube of color shifting film 16A is attached to and extends from attachment body 40.

Regardless of exact form, attachment body 40 connects tube of color shifting film 16A to handle 12A, while allowing light from light source 14A to interact with tube of color shifting film 16A. In this regard, attachment body 40 can be tubular in form, or may be a solid article configured to allow passage of light from light source 14A.

Figure 3:
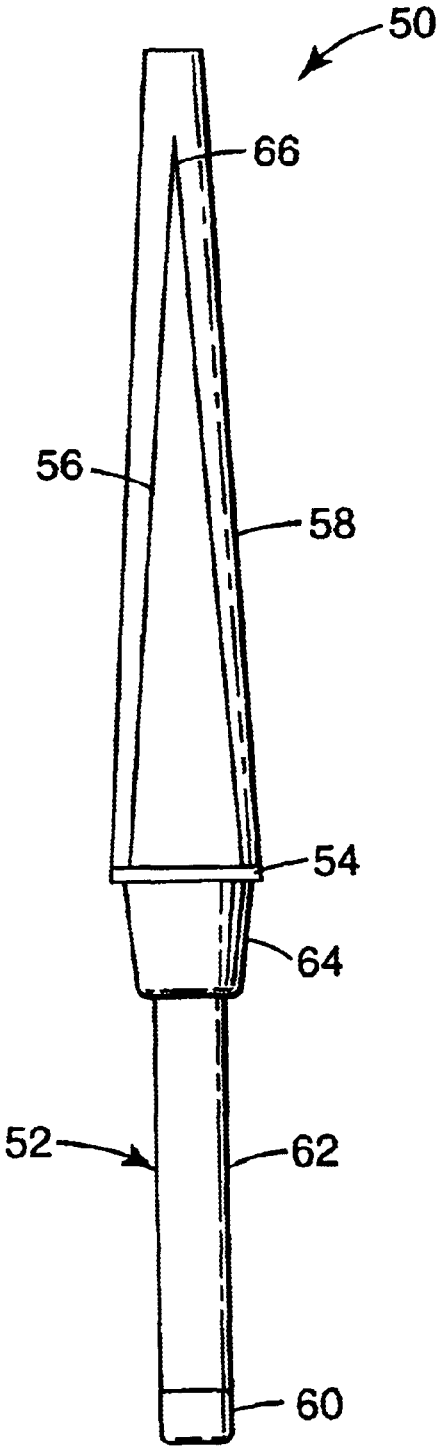
FIG. 3 is a side view of another hand-holdable toy light tube according to the present invention.

Another exemplary embodiment of a hand-holdable toy light tube according to the present invention is shown in FIG. 3. Hand-holdable toy light tube 50 includes handle 52, light source (not shown), attachment body 54, tube of color shifting film 56 and protective enclosure 58. Handle 52 includes end 60, body 62 and end 64. Light source (not shown) is disposed within end 64. Further, tube of color shifting film 56 and protective enclosure 58 are connected to end 64 of handle 52 via attachment body 54.

Tube of color shifting film 56 is preferably conical in shape, approximately, forming a tip at distal end 66.

In a preferred embodiment, protective enclosure 58 is a diffuse or clear material, such as plastic. Protective enclosure 58 is attached to and extends from end 64 of handle 52 and conforms generally to the shape of, and encloses, tube of color shifting film 56. In one embodiment, protective enclosure 58 is maintained separate from the tube of color shifting film 56. Alternatively, it may also be useful to attach tube of color shifting film 56 to an interior of protective enclosure 58 with an adhesive material.

In one embodiment, tube of color shifting film 56 is adhered (e.g., using an adhesive material) to protective enclosure 58. Suitable adhesive materials may be apparent to those skilled in the art, and include a high bond adhesive (available, for example, in a double-sided tape form from the 3M Company under the trade designation "VHB ADHESIVE" (#P9460PC)), an epoxy resin or binder, can also be used. Regardless of the exact form of the adhesive material used to secure the tube of color shifting film to the protective enclosure, the adhesive material is preferably optically clean to minimize the effect, if any, on the light from the light source to the tube of color shifting film.

Protective enclosure 58 is preferably rigid and serves to protect tube of color shifting film 56 from damage while allowing light from tube of color shifting film 56 to pass therethrough. Alternatively, protective enclosure 58 may be configured to assume an optical characteristic and filter light produced through tube of color shifting film 56. Protective enclosure 58 also assists in maintaining the extended position of tube of color shifting film 56 relative to handle 52.

As with previous embodiments, hand-holdable toy light tube 50 is preferably activated by rotational movement of end 64 relative to body 62. Light from light source (not shown) is directed into tube of color shifting film 56, resulting in a brilliant, multi-colored effect. Movement of handle 52 imparts a reciprocal movement onto tube of color shifting film 56 and protective enclosure 58. Protective enclosure 58 protects tube of color shifting film 56 from potential damage otherwise presented through accidental contact of hand-holdable toy light tube 50 with an object. Further, protective enclosure 58 maintains tube of color shifting film 56 in an extended position.

Figure 4:
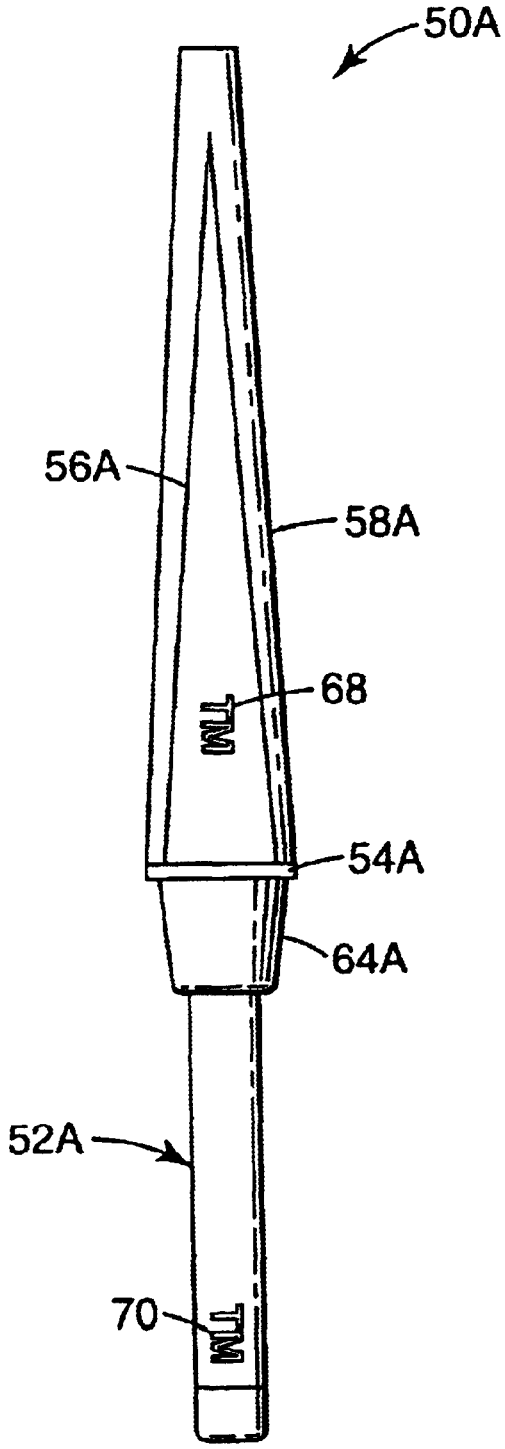
FIG. 4 is a side view of another hand-holdable toy light tube according to the present invention.

Another embodiment of a hand-holdable toy light tube 50A according to the present invention is shown in FIG. 4. Similar to hand-holdable toy light tube 50 of FIG. 3, hand-holdable toy light tube 50A includes handle 52A, light source (not shown), attachment body 54A, tube of color shifting film 56A and protective enclosure 58A. Tube of color shifting film 56A and protective enclosure 58A are attached to and extend from end 64A of handle 52A via attachment body 54A. Finally, light source (not shown) is disposed within end 60A of handle 52A.

Unlike previous embodiments, hand-holdable toy light tube 50A includes optional indicia 68 (which may be, for example, a (U.S.) federally registered trademark) on an outer circumference of protective enclosure 58A. Alternatively, for example, indicia 68 may be in the form of a copyright or copyrightable material or in the form of a trademark, including a registered or registrable trademark under any of the laws of the countries, territories, etc. of the world. In another respect, tube of color shifting film 56A can be configured to include optional indicia of a trademark (including a (U.S.) federally registered trademark) and/or copyrightable material as described above.

In another aspect, hand-holdable toy light tube 50A includes optional indicia 70 on the outer circumference of handle 52A. Alternatively, another trademark or copyrightable material as described above may be used.

Figure 5A:
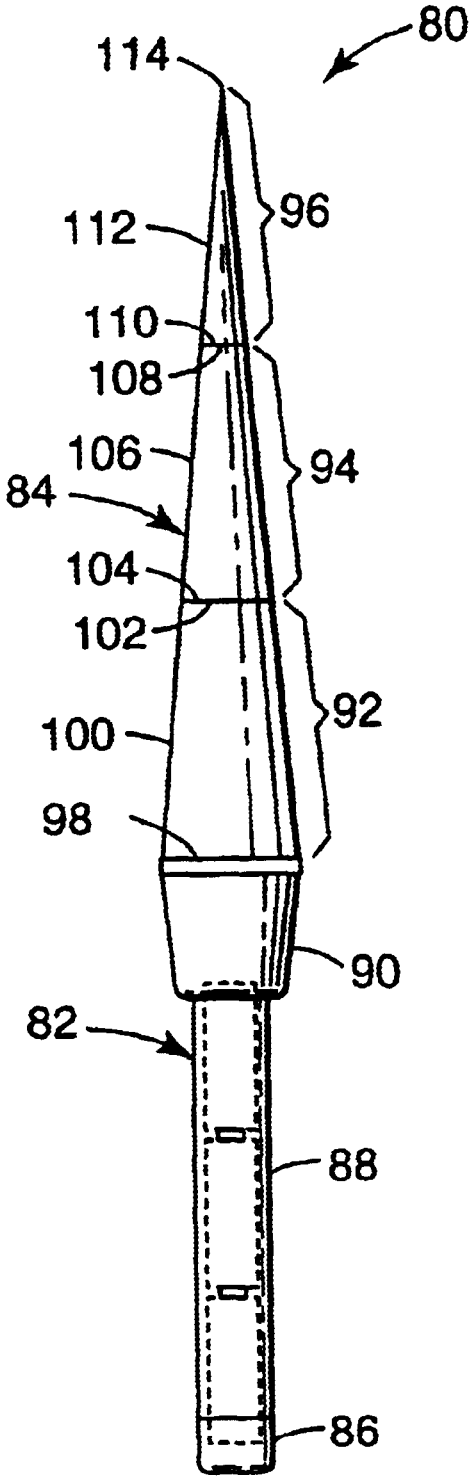
FIG. 5A is a side view of another hand-holdable toy light tube according to the present invention in an extended position.
Figure 5B:
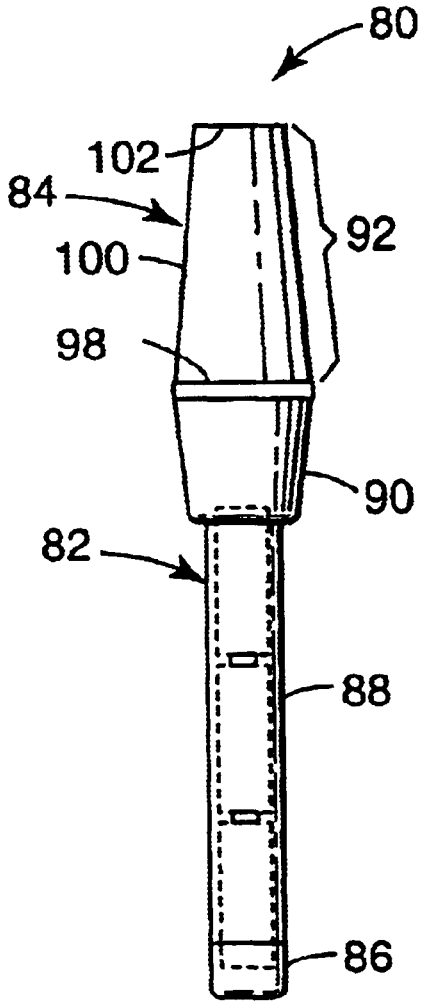
FIG. 5B is a side view of the hand-holdable toy light tube of FIG. 5A in a retracted position.

Yet another alternative embodiment of hand-holdable toy light tube according to the present invention is shown in FIGS. 5A and 5B. Hand-holdable toy light tube 80 includes handle 82, light source (not shown) and tube of color shifting film 84. Handle 82 includes end 86, body 88 and end 90. Light source (not shown) is disposed within end 90 of handle 82, which additionally functions as a switch in a preferred embodiment. Thus, rotational movement of end 90 relative to body 92 controls activation of light source (not shown).

Tube of color shifting film 84 includes first section 92, second section 94 and third section 96. First section 92 is configured to telescopically receive second section 94 and third section 96. In this regard, first section 92 includes proximal end 98, intermediate portion 100 and distal end 102. Similarly, second section 94 includes proximal end 104, intermediate portion 106 and distal end 108. Finally, third section 96 includes proximal end 110, intermediate portion 112 and distal end 114.

Proximal end 98 of first section 92 is sized for attachment to end 90 of handle 82. Further, intermediate portion 100 of first section 92 is sized to slidably receive second tube of color shifting film 86 in a telescopic fashion. In this regard, intermediate portion 100 of first section 92 preferably assumes a conical shape such that proximal end 98 has a larger diameter than distal end 102. Further, distal end 102 of first section 92 has a diameter slightly smaller than that of proximal end 104 of second section 94. Thus, second section 94 cannot disengage from first section 92 during use.

Second section 94 and third section 96 are constructed similar to first section 92, but with reduced diameters. Thus, second section 94 and third section 96 are preferably conical in shape. Intermediate portion 106 of second section 94 is sized to slidably receive third section 96. However, distal end 108 of second section 94 has a diameter slightly smaller than that of proximal end 110 of third section 96 such that third section 96 does not entirely disengage from second section 94 during use.

With the just described configuration, tube of color shifting film 84 can be maintained in either an extended position, as shown, for example, in FIG. 5A, or a retracted position as shown, for example, in FIG. 5B. In the extended position, second section 94 extends outwardly from first section 92 such that proximal end 104 of second section 94 is approximately adjacent distal end 102 of first section 92. In this regard, because proximal end 104 of second section 94 has a diameter slightly greater than that of distal end 102 of first section 92, second section 94 is frictionally maintained in the extended position. Third section 96 is similarly maintained in the extended position relative to second section 94. Additional stop or attachment devices may be employed to maintain the tube of color shifting film 84 in the extended position. In the retracted position (FIG. 5B), third section 96 and second section 94 slide within first section 92.

In one embodiment, each of first section 92, second section 94, and third section 96 are comprised of color shifting film. The color shifting film use for each of first section 92, second section 94, and third section 96 may be the same, or may differ for one or all sections 92–96. Thus, the color shifting film for first section 92 could exhibit a series of colors, while color shifting film for second section 94 and third section 96 exhibits a different series of colors. Alternatively, for example, other materials having differing optical characteristics may also be useful for one or two of sections 92, 94, or 96. Additionally, while tube of color shifting film 84 is shown as having three sections 92, 94, 96, a greater or lesser number may also be utilized. Hand-holdable toy light tube 80 may further include protective enclosure(s) encompassing each of first section 92, second section 94 and/or third section 96, either individually or as a whole.

During use, end 90 of handle 82 is rotated relative to body 88 to activate light source (not shown) via connection to a power supply (not shown). Alternatively, a finger-operated switch may be provided along an outer surface of handle 82. Light from light source is directed from end 90 into tube of color shifting film 84. In the extended position (FIG. 5A), at least a portion of tube of color shifting film 84, possibly including first section 92, second section 94, and third section 96, exhibits bright, brilliant colors in response to light from the light source. Similarly, in the retracted position (FIG. 5B), first section 92 exhibits a brilliant, multi-colored optical characteristic.

Hand-holdable toy light tube 80 can be maneuvered from the retracted position (FIG. 5B) to the extended position (FIG. 5A) by a rapid rotational movement of handle 82. Rotational movement of handle 82 is imparted onto first section 92. Centrifugal force generated by this rotational movement forces second section 94 and third section 96 into the extended position. Alternatively, for example, third section 96 can simply be grasped at distal end 114 by a user and pulled outwardly, thereby extending third section 96 and second section 94. Conversely, tube of color shifting film 84 is maneuvered from the extended position to the retracted position by pushing third section 96 toward handle 82. Once third section 96 is retracted within second section 94, continued force on distal end 108 of second section 94 will retract second and third sections 94, 96 within first section 92.

Figure 6A:
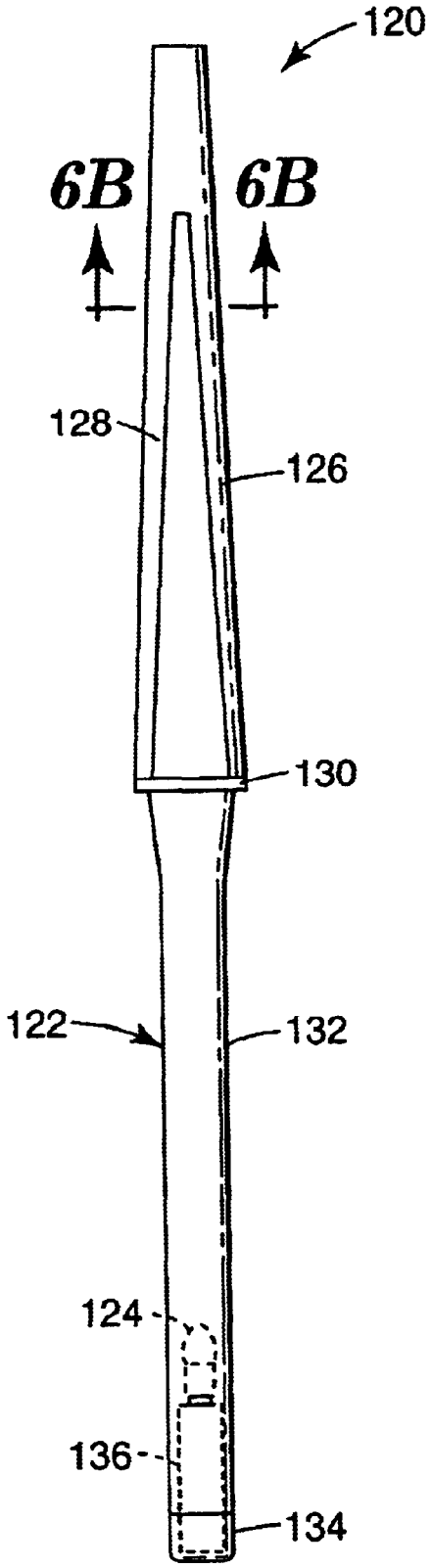
FIG. 6A is a side view of another hand-holdable toy light tube according to the present invention.
Figure 6B:
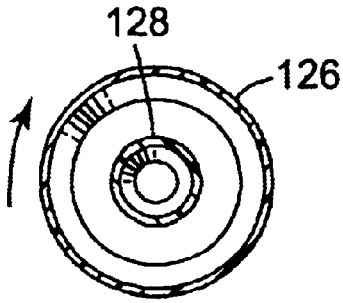
FIG. 6B is a cross-sectional view of the toy light tube of FIG. 6A along the line 6A—6A.

Yet another alternative embodiment of a hand-holdable toy light tube according to the present invention is shown in FIGS. 6A and 6B. Hand-holdable toy light tube 120 includes handle 122, light source 124, first tube of color shifting film 126 and second tube of color shifting film 128. Handle 122 includes end 130, body 132 and end 134. First and second tubes of color shifting film 126, 128 are attached to end 130 of handle 122, as tubes of color shifting film 126, 128 are attached to end 130 of handle 122, as described in greater detail below. Light source 124 is within body 132 of handle 122, near end 134. In other words, light source 124 is connected to handle 122 away from end 130 to which first and second tube of color shifting film 126, 128 are attached. Light source 124 is preferably configured to be powered by power source 136 (e.g., battery shown in dashed lines). While the light source is described as being within or connected to the handle, it is understood that the light source can be connected directly to the handle, or alternatively, connected to the handle via an intermediate structure or elements.

Handle 122 is configured to transmit light from light source 124 to end 130 at which first and second tubes of color shifting film 126, 128 are attached. Whatever the arrangement, the article is configured so that the light source illuminates at least a portion of the tube of color shifting film. In this regard, light from light source 124 can be transmitted by, for example, a visible mirror film lining an interior of handle 122. Alternatively, for example, handle 122 can be a light fiber or light tube. Even further, for example, at least a portion of handle 122 may include a partially reflective/partially transmissive film that directs some light to first and second tubes of color shifting film 126, 128, and allows some light to pass through the film, such that handle 122 appears glowing or brightly colored when light source 124 is activated. Notably, a device for transporting light from light source 124 to a region adjacent first and second tubes of color shifting film 126, 128 can be separate from, or integral with, handle 122. Even further, for example, light source 124 can be disposed entirely within first and second tubes of color shifting film 126, 128.

In one embodiment, first tube of color shifting film 126 is made of a color shifting film optically different from second tube of color shifting film 128. Further, first tube of color shifting film is rotatably secured to end 130 of handle 122. With this configuration, first tube of color shifting film 126 can be rotated relative to second tube of color shifting film 128, as shown by arrow 138 in FIG. 6A. The resulting color viewed by an observer of hand-holdable toy light tube 120 can thereby be altered by rotating first tube of color shifting film 126.

Hand-holdable toy light tubes according to the present invention provide an enhancement over existing illuminated tubes and fluorescent-colored cylinders. By incorporating an elongated tube of curved, color shifting film in conjunction with a light source, a brilliant, multi-colored toy light tube can be provided. Further, in one embodiment, use of a telescoping design for the tube of color shifting film enhances user enjoyment by providing a tube extendable, for example, through a simple movement of a user's wrist.

In an exemplary embodiment of such hand-holdable toy light tube according to the present invention, when illuminated and viewed normal to a principle axis of the tube of color shifting film, a center of a core of the tube of color shifting film appeared green, surrounded on each side by a layer of blue and then a layer of red. As the tube of color shifting film is tilted away from the viewer, the green disappears and the tube of color shifting film appears to have a blue core surrounded on each side by layers of red. Tilting the tube of color shifting film further causes the blue core to disappear and the entire tube of color shifting film appears red.

Depending upon the color shifting film used for the tube of color shifting film, the number and types of colors viewed will vary. Additionally, the effect achieved by tilting the tube of color shifting film toward a viewer may cause a different progression of colors than observed when tilting the tube of color shifting film away from the viewer.

Further, many adhesive materials may be used to laminate optical films and devices to another film, surface, or substrate. Such adhesive materials include pressure sensitive adhesives, hot-melt adhesives, solvent-coated adhesives, heat activated adhesives and the like. These adhesive materials preferably are optically clear, diffuse and exhibit non-hazy and non-whitening aging characteristics. Furthermore, the adhesive materials should exhibit long term stability under high heat and humidity conditions. Suitable adhesive materials may include solvent, heat, or radiation activated adhesive systems. Pressure sensitive adhesive materials are normally tacky at room temperature and can be adhered to a surface by application of light to moderate pressure.

Examples of adhesive materials, whether pressure sensitive or not and useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above.

Additionally, adhesive materials can contain additives such as tackifiers, plasticizers, fillers, antioxidants, stabilizers, diffusing particles, curatives, and solvents, provided they do not interfere with the optical characteristics of the devices. When additives are used they are used in quantities that are consistent with their intended use and when used to laminate an optical film to another surface, the adhesive composition and thickness are preferably selected so as not to interfere with the optical properties of the optical film. For example, when laminating additional layers to an optical film or device wherein a high degree of transmission is desired, the laminating adhesive material should be optically clear in the wavelength region that the optical film or device is designed to be transparent in.

Further, the surface(s) on which an adhesive material is applied or otherwise attached to may be primed (e.g., chemically, physical (e.g., physical treatment such as roughening), and corona) to affect the degree of attachment between the adhesive material and surface.

Components of toys according to the present invention can be made of any of a variety of materials (including those referred to herein). For example, non-metallic materials (e.g., rigid or non-rigid polymeric materials) or metallic materials. Other suitable materials may also be apparent to those skilled in the art after reviewing the disclosure of the present invention. Further, light tubes according to the present invention may further comprise glitter (including that disclosed in U.S. applications Ser. Nos. 09/006,291 and 09/006,293, filed Jan. 13, 1998, now abandoned, the disclosures of which are incorporated herein by reference). For example, the glitter can be loose within (i.e., inside of) the color shifting film.

The following two examples illustrate exemplary embodiments of the manufacture of color shifting films. Particular materials and amounts thereof recited in these examples, as well as other conditions and details, should not be construed to unduly limit this invention. All parts and percentages are by weight unless otherwise indicated.

EXAMPLE 1

The following example illustrates the preparation of a color shifting film.

A co-extruded film containing 209 layers was made on a sequential flat-film making line via a co-extrusion process. This multilayer polymer film was made from polyethylene naphthalate (PEN) and polymethyl methacrylate (PMMA CP82) where PEN was the outer layers or "skin" layers. A feedblock method (such as that described by U.S. Pat. No. 3,801,429) was used to generate about 209 layers which were co-extruded onto a water chilled casting wheel and continuously oriented by conventional sequential length orienter (LO) and tenter equipment. PEN with an intrinsic viscosity (IV) of 0.56 dl/g (60 wt. % phenol/40 wt. % dichlorobenzene) was delivered to the feedblock by one extruder at a rate of 60.5 kg/hr and the PMMA was delivered by another extruder at a rate of 63.2 Kg/hr. These melt streams were directed to the feedblock to create the PEN and PMMA optical layers. The feedblock created 209 alternating layers of PEN and PMMA with the two outside layers of PEN serving as the protective boundary layers (PBL's) through the feedblock. The PMMA melt process equipment was maintained at about 249° C.; the PEN melt process equipment was maintained at about 290° C.; and the feedblock, skin-layer modules, and die were also maintained at about 290° C.

An approximately linear gradient in layer thickness was designed for the feedblock for each material, with the ratio of thickest to thinnest layers being about 1.72:1. This hardware design of first-to-last layer thickness ratio of 1.73:1 was too great to make the bandwidth desired for the colored mirror of this example. In addition, a sloping blue band edge resulted from the as-designed hardware. To correct these problems, a temperature profile was applied to the feedblock. Selected layers created by the feedblock can be made thicker or thinner by warming or cooling the section of the feedblock where they are created. This technique was required to produce an acceptable sharp band edge on the blue side of the reflection band. The portion of the feedblock making the thinnest layers was heated to 304° C., while the portion making the thickest layers was heated to 274° C. Portions intermediate were heated between these temperature extremes. The overall effect is a much narrower layer thickness distribution which results in a narrower reflectance spectrum.

After the feedblock, a third extruder delivered a 50/50 blend of 0.56 dl/g IV and 0.48 dl/g IV PEN as skin layers (same thickness on both sides of the optical layer stream) at about 37.3 Kg/hr. By this method, the skin layers were of a lower viscosity than the optics layers, resulting in a stable laminar melt flow of the co-extruded layers. Then the material stream passed through a film die and onto a water cooled casting wheel using an inlet water temperature of about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web.

The cast web was length oriented with a draw ratio of about 3.8:1 at about 130° C. In the tenter, the film was preheated before drawing to about 138° C. in about 9 seconds and then drawn in the transverse direction at about 140° C. to a draw ratio of about 5:1, at a rate of about 60% per second. The finished film had a final thickness of about 0.02 mm.

Figure 7:
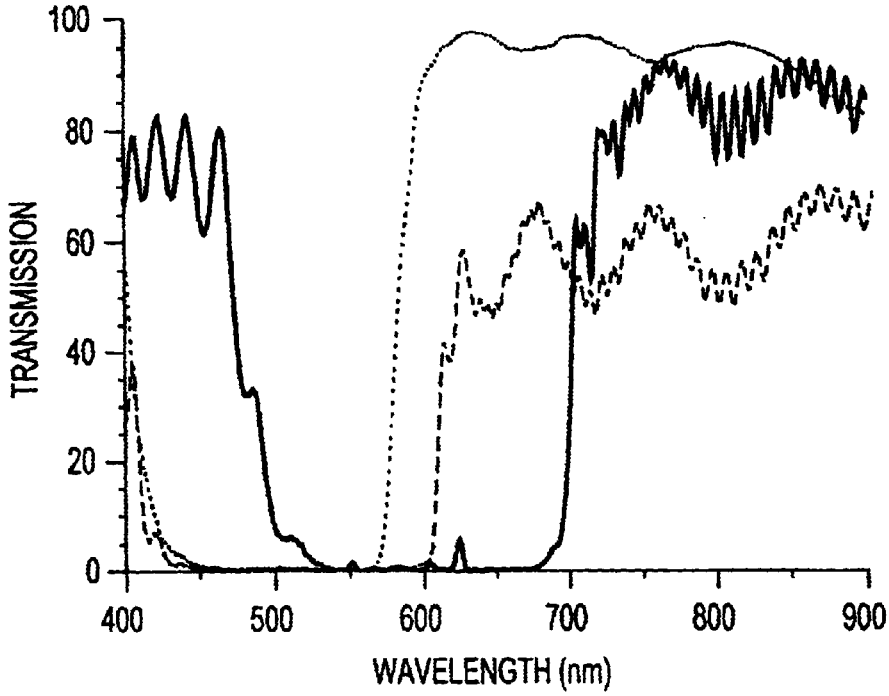
FIGS. 7 and 8 are optical spectra of two color shifting films.

The optical spectra for the film of this example are shown in FIG. 7. The film exhibited blue in transmission at normal incidence; yellow in reflection at normal incidence; red in transmission at oblique angles; and cyan in reflection at oblique angles.

EXAMPLE 2

The following example illustrates the preparation of a another color shifting film.

A multilayer film containing about 418 layers was made on a sequential flat-film making line via a co-extrusion process. This multilayer polymer film was made PET and polyester resin (available under the trade designation "ECDEL 9967" from Eastman Chemical Co. of Rochester, N.Y.) where PET was the outer layers or "skin" layers. A feedblock method (such as that described by U.S. Pat. No. 3,801,429) was used to generate about 209 layers with an approximately linear layer thickness gradient from layer to layer through the extrudate.

The PET, with an Intrinsic Viscosity (IV) of 0.56 dl/g was pumped to the feedblock at a rate of about 34.5 Kg/hr and the polyester resin ("ECDEL 9967") at about 41 Kg/hr. After the feedblock, the same PET extruder delivered PET as protective boundary layers (PBL's), to both sides of the extrudate at about 6.8 Kg/hr total flow. The material stream then passed though an asymmetric two times multiplier (U.S. Pat. Nos. 5,094,788 and 5,094,793) with a multiplier ratio of about 1.40. The multiplier ratio is defined as the average layer thickness of layers produced in the major conduit divided by the average layer thickness of layers in the minor conduit. This multiplier ratio was chosen so as to leave a spectral gap between the two reflectance bands created by the two sets of 209 layers. Each set of 209 layers has the approximate layer thickness profile created by the feedblock, with overall thickness scale factors determined by the multiplier and film extrusion rates.

The melt process equipment for the polyester resin ("ECDEL 9967") was maintained at about 250° C., the PET (optics layers) melt process equipment was maintained at about 265° C., and the feedblock, multiplier, skin-layer melt stream, and die were maintained at about 274° C.

The feedblock used to make the film for this example was designed to give a linear layer thickness distribution with a 1.3:1 ratio of thickest to thinnest layers under isothermal conditions. To achieve a smaller ratio for this example, a thermal profile was applied to the feedblock. The portion of the feedblock making the thinnest layers was heated to 285° C., while the portion making the thickest layers was heated to 265° C. In this manner the thinnest layers are made thicker than with isothermal feedblock operation, and the thickest layers are made thinner than under isothermal operation. Portions intermediate were set to follow a linear temperature profile between these two extremes. The overall effect is a narrower layer thickness distribution which results in a narrower reflectance spectrum. Some layer thickness errors are introduced by the multipliers, and account for the minor differences in the spectral features of each reflectance band. The casting wheel speed was adjusted for precise control of final film thickness, and therefore, final color.

After the multiplier, a thick symmetric PBL (skin layers) was added at about 28 Kg/hour that was fed from a third extruder. Then the material stream passed through a film die and onto a water cooled casting wheel. The inlet water temperature on the casting wheel was about 7° C. A high voltage pinning system was used to pin the extrudate to the casting wheel. The pinning wire was about 0.17 mm thick and a voltage of about 5.5 kV was applied. The pinning wire was positioned manually by an operator about 3–5 mm from the web at the point of contact to the casting wheel to obtain a smooth appearance to the cast web. The cast web was continuously oriented by conventional sequential length orienter (LO) and tenter equipment. The web was length oriented to a draw ratio of about 3.3 at about 100° C. The film was preheated to about 100° C. in about 22 seconds in the tenter and drawn in the transverse direction to a draw ratio of about 3.5 at a rate of about 20% per second. The finished film had a final thickness of about 0.05 mm.

Figure 8:
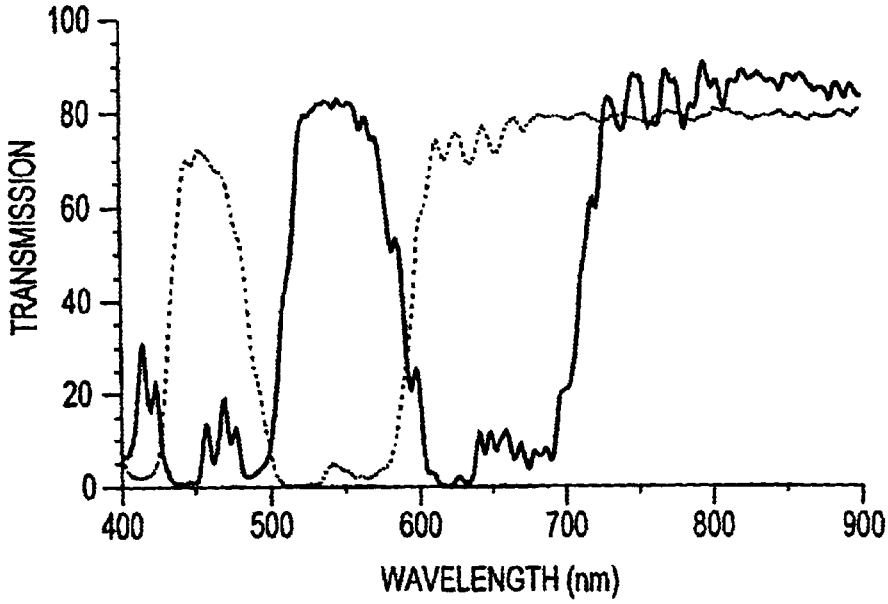

The optical spectra for the film of this example are shown in FIG. 8. The film exhibited green in transmission at normal incidence; magenta in reflection at normal incidence; magenta in transmission at oblique angles; and green in reflection at oblique angles.

It is to be noted that many different colors can be, for example, produced by modifying one or more parameters of the procedures described in Examples 1–2. Thus, for example, within certain limitations, the speed of the casting wheel can be adjusted to result in relative thickening or thinning of the optical layers within the extruded web. This results in a shift of the reflectance band to a different wavelength, which changes the color of the resulting film at a given angle of incidence.

EXAMPLE 3

The following example illustrates the preparation of a visible mirror film.

A coextruded film containing 601 layers was made on a sequential flat—filmmaking line via a coextrusion process. A polyethylene naphthalate (PEN) with an intrinsic viscosity of 0.57 dl/g (60 wt %% phenol/40 wt % dichlorobenzene) was delivered by extruder A at a rate of 114 pounds per hour with 64 pounds per hour going to the feedblock and the rest going to skin layers described below. PMMA (CP-82 from ICI of Americas) was delivered by extruder B at a rate of 61 pounds per hour with all of it going to the feedblock. PEN was on skin layers of the feedblock. The feedblock method was used to generate 151 layers using the feedblock such as those described in U.S. Pat. No. 3,801,429, after the feedblock two symmetric skin were coextruded using extruder C metering about 30 pounds per hour of the same type of PEN delivered by extruder A. This extrudate passed through two multipliers producing an extrudate of about 601 layers. U.S. Pat. No. 3,565,985 describes similar coextrusion multipliers. The extrudate passed through another device that coextruded skin layers at a total rate of 50 pounds per hour of PEN from extruder A. The web was length oriented to draw ratio of about 3.2 with the web temperature at about 280° F. The film was subsequently preheated to about 310° F. in about 38 seconds and drawn in the transverse direction to a draw ratio of about 4.5 at a rate of about 11% per second. The film was then heat-set at 440° F. with no relaxation allowed. The finished film thickness was about 3 mil.

Various modifications and alterations of this invention will become apparent to those skilled in the art without departing from the scope and spirit of this invention, and it should be understood that this invention is not to be unduly limited to the illustrative embodiments set forth herein. For example, while the tube of color shifting film has been described as preferably being approximately conical in shape, other variations may also be useful. For example, the tube of color shifting film may be an approximate right cylinder to resemble a wand or baton. Further, the tube of color shifting film may include indentations and extensions to more closely resemble, for example, a special sword, wand or other device used, for example, by a movie, television, or cartoon character.

What is claimed is:

1. A toy light tube comprising:

a handle including an end;

a tube of color shifting film extending from said end; and a light source connected to said handle, wherein when activated, said light source interacts with at least a portion of said tube of color shifting film producing an optical effect visible to at least one of a user or observer, wherein said light source is configured to emit visible light, and wherein at least a portion of said tube of color shifting film is configured such that if maintained in a stationary position and viewed from a first location, said portion of said tube of film exhibits a first color, and when viewed from a second location and maintained in a stationary position, said portion of said tube of film exhibits a second color different from said first color.

2. The toy light tube of claim 1, further comprising:

a power source electrically coupled to said light source.

3. The toy light tube of claim 2, wherein said power source is a battery.

4. The toy light tube of claim 2, further comprising:

a switch operably connected between said power source and said light source for controlling activation of said light source.

5. The toy light tube of claim 1, wherein said light source is configured to emit visible light.

6. The toy light tube of claim 5, wherein said tube of color shifting film is configured such that when viewed from a first location, at least a portion of said tube of color shifting film exhibits a first optical characteristic, and when viewed from a second location, said portion of said tube of color shifting film exhibits a second optical characteristic different from said first optical characteristic.

7. The toy light tube of claim 5, wherein at least a portion of said tube of color shifting film is configured such that when viewed from a first location, said portion of said tube of color shifting film exhibits a first color, and when viewed from a second location, said portion of said tube of color shifting film exhibits a second color different from said first color.

8. The toy light tube of claim 1, wherein said light source is switchable between a powered state and an unpowered state, at least a portion of said tube of film being configured to exhibit a more brilliant color when said light source is in said powered state than in said unpowered state.

9. The toy light tube of claim 1, further comprising:

an attachment body for connecting a portion of said tube of color shifting film to said end of said handle.

10. The toy light tube of claim 1, further comprising:

a filter disposed between said light source and said tube of color shifting film.

11. The toy light tube of claim 10, wherein said filter is color shifting film.

12. The toy light tube of claim 1, wherein said tube of color shifting film exhibits indicia.

13. The toy light tube of claim 1, wherein an outer surface of said handle displays indicia.

14. The toy light tube of claim 1, further comprising:

an enclosure extending from said end of said handle and encompassing at least a portion of said tube of color shifting film.

15. The toy light tube of claim 14, wherein said enclosure is diffuse.

16. The toy light tube of claim 14, wherein said enclosure is clear.

17. The toy light tube of claim 14, wherein said enclosure is plastic.

18. The toy light tube of claim 1, wherein said light source comprises an incandescent lamp.

19. The toy light tube of claim 1, wherein said light source comprises a halogen lamp.

20. The toy light tube of claim 1, wherein said tube of color shifting film includes a first section and a second section, said second section being slidably disposed within said first section.

21. The toy light tube of claim 20, wherein said first section includes a proximal end, an intermediate portion and a distal end, said proximal end configured to be attached to said end of said handle.

22. The toy light tube of claim 21, wherein said second section includes a proximal end, an intermediate portion and a distal end, said second section being configured such that said proximal end of said second section has a diameter slightly greater than that of said distal end of said first section.

23. The toy light tube of claim 22, wherein said first section and said second section are approximately conical.

24. The toy light tube of claim 1, wherein said light source is proximate said end of said handle.

25. The toy light tube of claim 1, wherein said light source is remote from said end of said handle, and said handle is configured to transmit light from said light source to at least a portion of said tube of color shifting film.

* * * * *